US005348172A

United States Patent [19]

Wilson

[11] Patent Number: 5,348,172

[45] Date of Patent: Sep. 20, 1994

[54] INDUSTRIAL CARRYING MACHINE

[76] Inventor: Frederick F. K. Wilson, 52 Dickerson Rd., Griffin, Ga. 30223

[21] Appl. No.: 25,562

[22] Filed: Mar. 2, 1993

[51] Int. Cl.[5] ..... B66C 23/76

[52] U.S. Cl. ..... 212/196; 212/189

[58] Field of Search ..... 212/140, 141, 142, 178, 212/189, 195, 196, 197, 198, 199, 156

[56] References Cited

U.S. PATENT DOCUMENTS

| | | | |
|---|---|---|---|
| 691,349 | 1/1902 | Bills | 212/196 |
| 911,632 | 2/1909 | Van Wie | 212/197 |
| 1,195,058 | 8/1916 | Marfell | 212/196 |
| 1,448,814 | 3/1923 | Norris | 212/181 |
| 1,828,905 | 10/1931 | Mossay | 212/141 |
| 1,840,522 | 1/1932 | Mossay . | |
| 2,068,397 | 1/1937 | Chapman | 212/195 |
| 2,421,437 | 6/1947 | Ryan et al. | 179/152 |
| 2,557,852 | 6/1951 | Winkel | 212/61 |
| 2,750,204 | 6/1956 | Ohrmann | 212/189 |
| 2,774,484 | 12/1956 | White | 212/178 |
| 2,804,216 | 8/1957 | Farnam | 212/252 |
| 3,432,145 | 3/1969 | Mudge | 212/252 |
| 3,822,791 | 7/1974 | Eiler | 212/178 |
| 3,888,463 | 6/1975 | O'Brien et al. | 254/10 |
| 3,926,316 | 12/1975 | Luttrell | 212/59 |
| 4,241,803 | 12/1980 | Lauber | 212/189 |
| 4,397,479 | 8/1983 | Schmidt | 212/189 |
| 4,597,498 | 7/1986 | Spinosa et al. | 212/189 |
| 4,763,800 | 8/1988 | Engler et al. | 212/195 |
| 4,782,962 | 11/1988 | Hackworth et al. | 212/195 |
| 5,120,186 | 6/1992 | Jorgenson | 212/189 |
| 5,203,837 | 4/1993 | Madic et al. | 212/197 |

FOREIGN PATENT DOCUMENTS

| | | | |
|---|---|---|---|
| 105168 | 9/1899 | Fed. Rep. of Germany | 212/196 |
| 1038429 | 9/1953 | France | 212/196 |

*Primary Examiner*—Michael S. Huppert
*Assistant Examiner*—Thomas J. Brahan
*Attorney, Agent, or Firm*—Hopkins & Thomas

[57] ABSTRACT

A mobile crane has a triangular wheel arrangement with a steerable front wheel and a frame for carrying an operator and a boom which is adjustable both as to vertical angle and azimuth. Shock absorbing stabilizing arm assemblies extend from either side of the frame, and an adjustable counterweight assembly is pivotally mounted at the rear of the frame, and can be adjusted to its optimum position, depending on the load, by the operator without his having to exert any lifting effort. The crane boom is likewise adjustable as to azimuth and elevation angle without the operator's having to move any heavy weight.

5 Claims, 3 Drawing Sheets

INDUSTRIAL CARRYING MACHINE

FIELD OF INVENTION

This invention relates to lifting devices, and more particularly, to a mobile crane type device for handling heavy loads.

BACKGROUND OF INVENTION

As is often the case, in those areas where heavy loads must be moved, such as machine shops, auto repair shops, and the like, the employees or workers are in a danger of injuring their backs while lifting or carrying heavy or awkward loads, with subsequent partial or complete incapacitation insofar as their work is concerned. Such back injuries also lead to an inability to perform even normal lifting functions, such as loading luggage into or extracting it from the trunk of a car. Some manner of lifting device, such as a crane, is helpful in all such cases for the person called upon to lift any heavy, or even moderately heavy, articles, to transport them, and to deposit them in a desired location, however, heretofore, most such cranes are too unwieldy for small, mundane tasks.

In general, a crane consists of an elongated boom swivelly mounted on a support structure and movable in azimuth so that the boom may be swung from side to side. The distal end of the boom usually has a pulley or grooved wheel rotatably mounted thereon and over which a lifting cable is passed. The cable itself is paid out from, for example, a drum under control of a winch motor, and the angle of the boom itself relative to the ground generally remains fixed during the lifting operation. For increased versatility and convenience, the boom and associated support structure are often mounted on a mobile platform, which may range from a railroad car to a steerable tricycle arrangement of small wheels. Such mobile cranes as the latter can be used to carry heavy or awkward loads from one place to another, thereby relieving the operator from handling such loads. Typical light weight mobile crane arrangements are shown in U.S. Pat. Nos. 1,840,522 of Mossay and 4,782,962 of Hackworth, et al. Both of these patents disclose cranes which are movable in angular elevation, i.e., the angle of the boom relative to the ground may be adjusted for optimum stability and lifting characteristics. However, the entire structure of the crane has to be moved to change the azimuth direction. In addition, the adjustment of the boom angle, relative to the ground, must be done manually by the operator, which, in the case of a severely handicapped user, can be quite difficult, especially where the boom itself is heavy.

Where the crane or lifting device is to be used for carrying a load from place to place, it is desirable, although not necessary, that the operator be carried by the mobile crane also. To this end, such devices are supplied with a seat for the operator from which he may operate the crane. Examples of such seating arrangements are shown in U.S. Pat. Nos. 2,421,437 of Ryan, et al., 3,926,316 of Luttrell, and 4,763,800 of Engler, et al., in all of which are disclosed seating arrangements for the operator from which he may manipulate the lifting or carrying crane or platform. Of these patents, however, only that of Engler, et al. discloses a motorized or power operated platform and lifting device.

Usually, the mobile type cranes have either a three wheel triangular arrangement as shown in the Mossay patent or a four wheel arrangement as shown in the Luttrell and Hackworth et al. patents, and can be steered by manipulating the wheels, or in the case of Luttrell, by using the feet. In a triangular arrangement, the optimum longitudinal stability is achieved by having the apex of the triangle extend forward under the boom along the longitudinal axis, to prevent the weight at the distal end of the boom from tilting the crane body. However, when the boom, carrying a load, is swung to the side at an angle to the longitudinal axis, the triangular support arrangement can become unstable even to the extent of tipping over. It is known to use laterally extending stabilizer arms to impart stability to the platform and thereby minimize any tendency to tip over. Such arms usually have their distal ends terminating in a flat foot, and, after the load has been lifted, the arms are re-folded up to permit movement of the crane over the ground. Thus, the stability afforded by the arms is lost during transport of the load.

Many cranes, especially the mobile type, are equipped with a counterweight arrangement located on the opposite side of the crane fulcrum from the boom, to compensate for heavy loads carried by the boom. Such counterweights are shown in Mossay, Hackworth et al., and Engler et al. patents. Of particular interest is the arrangement shown by Engler et al. in which the counter weight is made adjustable by the addition or subtraction of weight members. Such an arrangement as shown by Engler et al. requires that the operator lift the weights to place or remove them, which, for handicapped people or people with bad backs, at least to some extent defeats the purpose of a crane designed for use by such people.

SUMMARY OF THE INVENTION

The present invention is a lightweight motor driven mobile crane designed to carry an operator, and which is capable of lifting and carrying heavy and awkward loads with a minimum of effort on the part of the operator.

In a preferred embodiment thereof, the mobile crane of the invention comprises a carriage frame having a triangular wheel arrangement supporting a platform upon which a support post and a boom, adjustable in both azimuth and angular elevation, are mounted. The wheel located at the apex of the triangle that falls along the longitudinal axis of the crane is made steerable, either from an operator's seat mounted on the platform, or from beside the machine. It is also possible to make the apparatus steerable and controllable by remote control, such as by radio or by an electrical connection between a hand carried control unit and a control module mounted on the machine. In the illustrative embodiment of the invention, a control panel is located adjacent the operator's seat for controlling the crane drive motor and a winch motor for driving a cable storage drum, which is used to pay out and wind up the lifting cable. The cable itself extends out to the distal end of the elongated boom, over a grooved wheel mounted thereon, and preferable ends in a hook or other type lifting device. The boom is swivelly and pivotally mounted atop the support post. The boom may be adjusted in azimuth by the operator while seated on the machine by his releasing a detent dog from the cogs of a cogwheel to which the boom is attached and rotating both boom and wheel by hand to the desired azimuth orientation, after which the detent dog reengages the cogwheel. The boom and cogwheel are readily moveable on the support post so that little effort on the part of the operator is required to move them by hand. Alternatively, a rotating gear box actuated by a wheel or crank may be used to move the boom.

In accordance with an aspect of the invention, the angular position of the boom relative to the ground, and hence the apparatus platform, can be adjusted and fixed by the operator while in his seat. To this end, the boom, which is pivotally mounted to the cogwheel, has a bracket depending from the underside thereof to which the end of the cable can be hooked. Actuation of the winch motor to wind the cable on the drum then raises the distal end of the boom to the desired position, and a retaining chain is then hooked from the end of the boom to a bracket or hook mounted on the top of the cogwheel. In this manner, the operator adjusts the boom elevation angle for optimum lift characteristics without leaving his seat, and without the necessity of lifting the boom by hand.

In order that the boom may be swung to the side to lift and carry a load without tipping, the carriage frame has mounted thereto a pair of stabilizing arm assemblies, one on either side of the longitudinal axis and extending substantially normal thereto. Each arm assembly is pivotally mounted to the frame with its distal end supporting a wheel assembly. Associated with each arm is a pair of spring loaded shock absorbing travel limiters, each having one end pivotally mounted to the frame and at the other end a bushing pivotally mounted to the wheel assembly. A shaft extends through the bushing and is free to slide relative thereto the extent of its travel being limited by a stop member against which a shock absorbing spring bears. With such an arrangement, the arm assemblies can adjust to surface irregularities as the carriage frame, and hence the crane, is moved over the ground, while at the same time providing lateral stability to the crane so that the tendency to tip to the side under off-center loads is minimized. For additional stability when the crane is stationary, manually positioned outriggers may be placed on each side at the rear of the crane.

In accordance with another feature of the invention, a counterweight assembly having a pair of arms pivotally mounted at the rear of the frame and a counterweight member supported by the arms can be swung from a substantially vertical position to a substantially horizontal position, or any angular position therebetween, depending on the load being carried by the crane. In order that the operator may set the counterweight to its desired position a grooved wheel over which the cable can be passed is mounted on the support post. The end of the cable is then passed through the grooved wheel and then hooked or otherwise attached to the counterweight, and the cable is paid out by operation of the winch motor until the counterweight assembly is in the desired position. A retaining chain is then hooked between the counterweight and the support post and the cable is returned to its normal, load carrying position. In this manner, the counterweight is adjusted by the operator without his being required to move any heavy weights.

Where the load to be carried is to be deposited in a relatively inaccessible place, e.g., a box of groceries in the rear seat of an automobile, an auxiliary boom, which can be pivotally mounted to the main boom and to which the cable is connected, is provided. When the auxiliary boom is in place and the cable attached thereto, it extends longitudinally past the distal end of the main boom and hence, can be directed into the aforementioned relatively inaccessible places.

Mounted above and to the rear of the winch motor and cable storage drum is a pulley or grooved wheel over which the cable can be placed to extend down to a detachable grooved wheel mounted on a small stabilizing wheel assembly at the rear of the crane. The cable passes under the grooved wheel and extends to the rear, then enabling the crane to pull heavy objects, even an automobile.

The mobile crane of the invention thus enables an operator to control the crane and the boom, to position the boom, to set the counterweight, and, in general, perform all of the useful crane functions without the necessity of manually lifting or moving any heavy weights and, in most cases, without leaving his seat on the crane. The crane itself is relatively lightweight and completely mobile, and has a lifting capacity ranging from a bag of groceries to a small tractor.

The aforementioned and numerous other features and advantages of the invention will be readily apparent from the following detailed description, read in conjunction with the accompanying drawings.

DETAILED DESCRIPTION

Figure 1A:
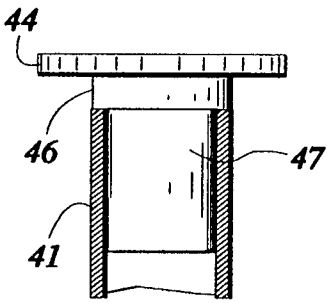
FIG. 1A is a partial cross-sectional view of a detail in the mobile crane of FIG. 1.
Figure 1:
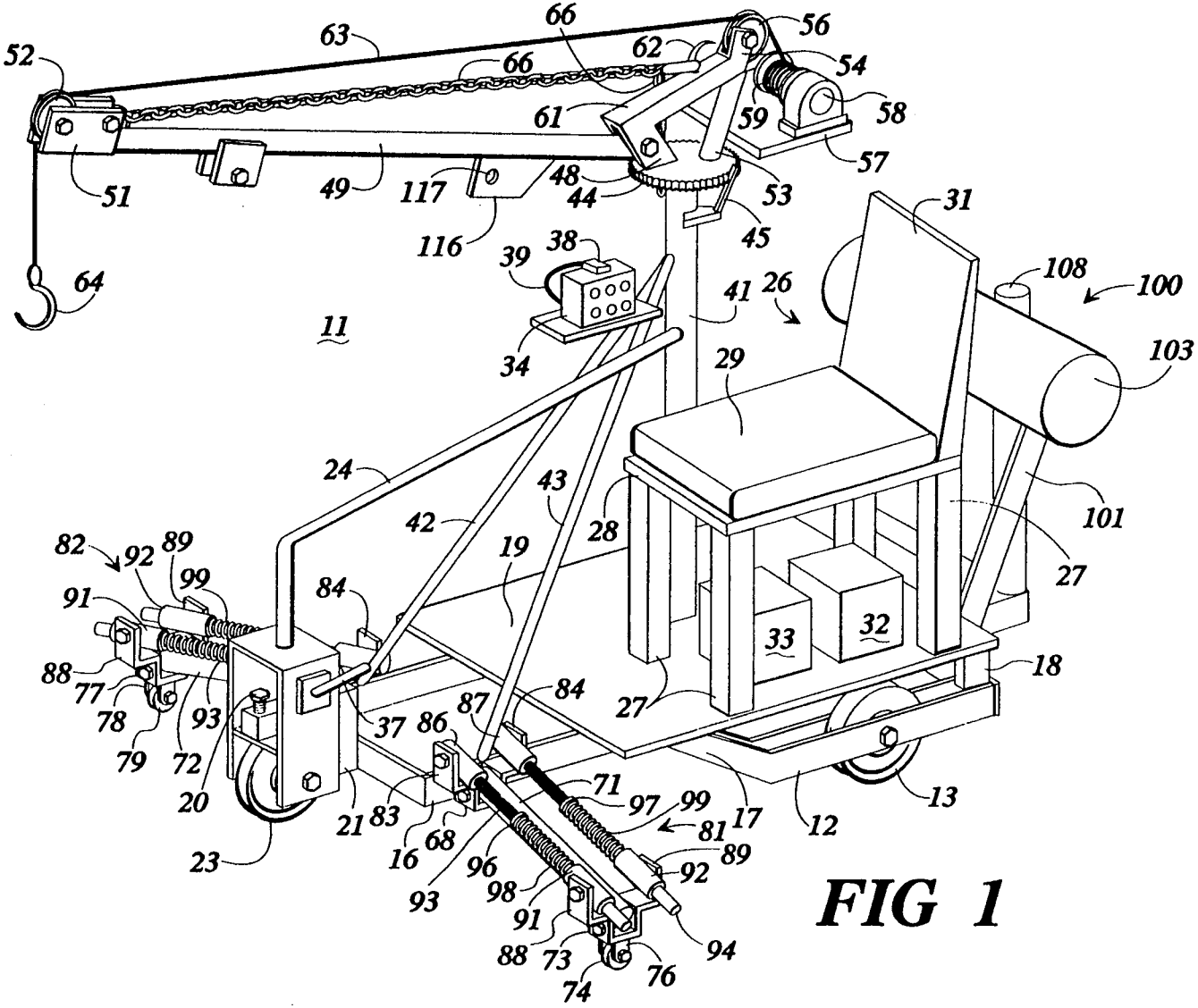
FIG. 1 is a perspective view of the mobile crane of the invention.

In FIG. 1 there is shown a mobile crane assembly 11 which embodies the principles of the present invention. Crane assembly 11 comprises a frame member 12 upon which are mounted support wheels 13 and 14, only 13 being show in FIG. 1. Wheels 13 and 14 are journaled on frame 12 and rotatable with respect thereto. Frame 12 is preferably made of steel and has a front portion 16 extending therefrom, which is preferably welded to the main portion of frame 12. Mounted above frame 12 and supported therefrom by means of posts 17, 17 and 18, 18 is a platform 19 preferably made of heavy gauge sheet steel welded to the posts 17, 17 and 18, 18 which are preferably welded to frame 12.

An L-shaped member 21 is mounted to front portion 16 of the frame and pivotally supports a U-shaped steering bracket 22. Rotatably mounted at the open end of bracket 22 is a support wheel 23 aligned with the centerline of the 30 frame 12. A steering lever 24 extends from bracket 22 towards an operator's seat 26 comprising support legs 27, 27 mounted on platform 19 and affixed thereto, a seat portion 28 holding a cushion 29, and a back portion 31.

Wheels 13 and 14 are driven by any suitable means, such as, for example, an electric motor 32 powered by a battery 33. The drive connections from motor 32 to wheels 13 and 14 are not shown, but may take any of a number of configurations within the purview of workers in the art. It is also possible to use other forms of motive power, such as a gasoline engine, for example, but experience has shown that an electric motor is both economical and feasible and operable both in enclosed spaces or out of doors. An operator, sitting in seat 26, can steer the assembly by means 24, causing bracket 22 to swivel on its mount 20. In addition, a control panel 34 is provided to enable the operator to actuate motor 32 to move the assembly forward or in reverse, or to brake the assembly as by dynamic braking.

Extending from bracket 22 on either side thereof are rods 36 and 37 to facilitate steering the assembly when the operator, for whatever reason, is not riding on the assembly but walking beside it. Steering is accomplished by simply slipping a length of pipe, not shown, over either rod 36 or 37 and thereby manipulating or controlling the swiveling of bracket 22. In such a case, i.e., the operator walking beside the machine, control can be accomplished through a hand control unit 38 connected to control unit 34 by means of a cable 39 of sufficient length. It is also possible to have unit 38 as a true remote unit which signals unit 34 by means of radio or infra-red waves. In such a case, it is also possible to have unit 34 control a steering motor, not shown, so that the operator may stay well away from crane during operation without surrendering or diminishing control thereof. Where the operator is severely handicapped, e.g., wheelchair bound, he may still operate the crane through its full range of functions and capability by means of radio control, for example.

Mounted on platform 19 to one side of seat 26 is a tubular support post 41, which is affixed to platform 19 by welding or other suitable means, and which is braced by a pair of bracing members 42 and 43, welded to post 41 and, at their lower ends, to frame portion 16. Rotatably mounted at the top of support post 41 is a cog wheel 44 having a shoulder 46 which rests on the top of post 41 and an elongated portion 47 which extends down into hollow post 41 and is journaled therein, as best seen in FIG. 1A. Portion 47 is preferably a slip fit in post 41 and rotatable with respect thereto, thereby making cog wheel 44 rotatable with respect to post 41. Cog wheel 44 thus may be rotated by hand or by moving the boom itself by hand, or rotation may be achieved by means of an electric or other type motor and suitable gearing. A detent dog 45 is mounted to post 41 and is adapted to hold cog wheel in a fixed position by engaging the cogs of the wheel. Dog 45 may take any of a number of forms, such as a stiff leaf spring disengagable from wheel 44 to permit rotation thereof. It is to be understood that other means for rotatably mounting cog wheel 44 to post 41 might be used, that shown here being by way of example only. A bracket 48 is mounted on the top surface of cog wheel 44 and one end i.e., the proximal end, of a boom 49 is pivotally mounted thereto. The other end, i.e., the distal end of boom 49 terminates in a bracket 51 in which a grooved guide wheel 52 is rotatably mounted. Also mounted on the top surface of cog wheel 44, as by welding, is an upwardly and rearwardly extending support post 53 which terminates in a bracket 54 in which a grooved wheel 56 is rotatably mounted. Support post 53 supports a plate 57 upon which are mounted a winch motor 58 and a cable take-up drum 59. To strengthen the assembly, bracket 48 and support post 53 are joined by a strength member 61 welded thereto and which has a chain hook 62 mounted thereon. A lifting cable 63 which is wound on drum 59 extends therefrom over grooved wheel 56, along the length of boom 49, over grooved wheel 52, and terminates in a hook 64. Hook 64 is intended to represent any of a number of known load bearing coupling devices with which it can be replaced, depending upon the type of load to be handled or the particular use to which the crane is put. A retaining chain 66 is hooked or otherwise swivelly connected at one end to bracket 51 by suitable means 50 and is hooked to member 62 near its other end by a suitable means 67. As will be apparent hereinafter, the number of chain links between bracket 51 and hook 62 will vary, depending upon the vertical angular orientation of boom 49, and chain 66 keeps the boom 49 at the desired angle.

Mounted above and to the rear of the winch motor 58 and drum 59 by means of a support bracket 55 welded to plate 57 and support post 53 as shown, is a grooved wheel 60 which is used when the crane 11 is used to pull heavy objects, as will be explained hereinafter.

Figures 3, 4, 5:
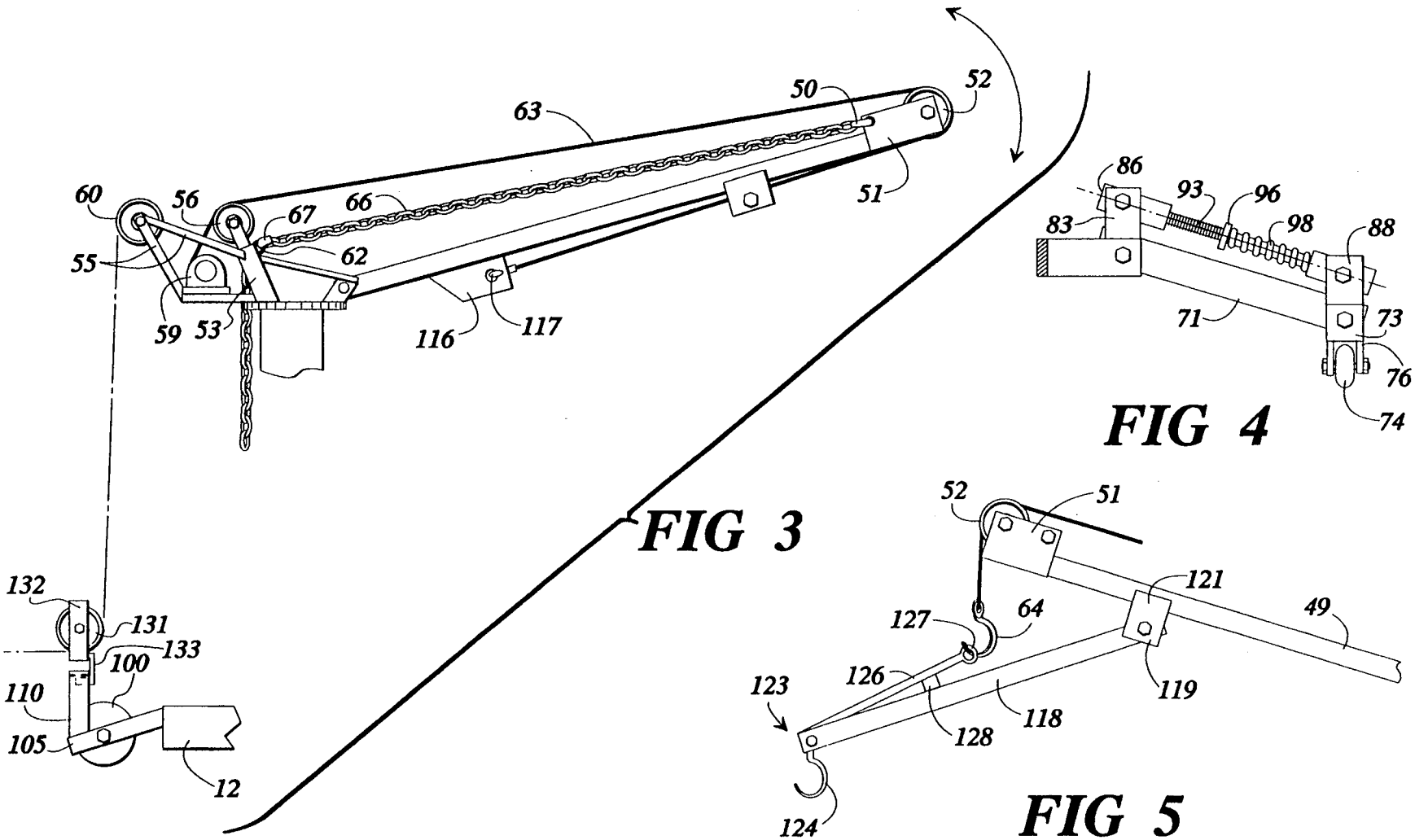
FIG. 3 is a view, inside elevation, of the arrangement for adjusting the vertical angle of the boom of the crane.
FIG. 4 is an elevation view of the side stabilizer assembly of the invention.
FIG. 5 is a view of the portion of the crane of the invention illustrating the auxiliary boom arrangement.

On either side of frame portion 16 as best seen in FIGS. 1 and 4, are brackets 69 and 69, only bracket 68 on the left side of portion 16 being shown in FIG. 1. A stabilizing assembly comprising a laterally extending stabilizing arm 71 is pivotally mounted at one end to bracket 68, and a similar laterally extending arm 72 is pivotally mounted at one end to bracket 69. The distal end of arm 71 terminates in a bracket 73 to which it is swivelly mounted, and which has a caster wheel 74 mounted thereto. Wheel 74 is mounted in a bracket 76 which, in turn, is pivotally mounted to bracket 73. In a like manner, arm 72 terminates in a bracket 77 having a bracket 78 carrying a caster wheel 79 and which is pivotally mounted to bracket 77. As thus far described, arms 72 and 73 can be swiveled up and down as the crane assembly moves over an uneven surface. In order that the range of travel of arms 71 and 72 be limited so as to insure continuing stability of the crane 11, the stabilizing assembly also includes shock absorbing limiter assemblies 81 and 82 which are mounted adjacent arms 71 and 72 respectively.

In as much as limiter assemblies 81 and 82 are substantially identical, like components thereof are given like reference numerals in the following description. Mounted on bracket 68 (and bracket 69) are first and second bracket members 83 and 84 to which are pivotally mounted cylindrical members 86 and 87° Also, mounted on bracket 73 (and bracket 78) are third and fourth bracket members 88 and 89 to which are pivotally mounted bushings 91 and 92, respectively. Affixed to cylindrical member 86 and extending therefrom is a rod 93 which passes through bushing 91 and is free to slide back and forth therein. In like manner, a rod 94 extends from member 87 through bushing 92. Each of rods 93 and 94 is threaded along a major portion of its length, and adjustable stop members 96, 97 are threaded on rods 93 and 94 respectively. A coil spring 98 surrounding rod 93 bears against bushing 91 at its one end and against stop member 96 at its other end. Thus, the compression of spring 98 can be varied by moving stop member 96 back and forth along rod 93. In like manner, a coil spring 99 surrounds rod 94 and bears against bushing 92 and stop member 97.

In operation, as crane assembly 11 moves over uneven ground, arms 71 and 72 will pivot up and down as the wheels 74 and 79 follow the contours of the ground or other surface. As arm 71, for example, pivots upward, springs 98 and 99 compress, thereby increasingly resisting further pivoting of arm 71 until a point is reached where the arm 71 can pivot no further, thereby limiting the extend of upward travel of arm 91. The springs 98 and 99 are preferably, under some compression at all times, thereby forcing and maintaining wheel 74 in contact with the supporting ground or surface. The springs 98 and 99 also act to absorb shocks while minimizing transmission of such shocks to the crane carriage. When boom 49 is directed to the side to lift an object, as the object is lifted, the crane 11 may be subjected to a tipping moment. The stabilizer arms 71 and 72 and limiter assemblies 81 and 82 will allow some slight tipping or rocking of the crane, but prevent any tendency of the crane 11 to tip over. The degree of tipping or rocking can be decreased by screwing stop members 96 and 97 down rods 93 and 94 respectively, thereby placing springs 98 and 99 under greater compression.

Figure 2:
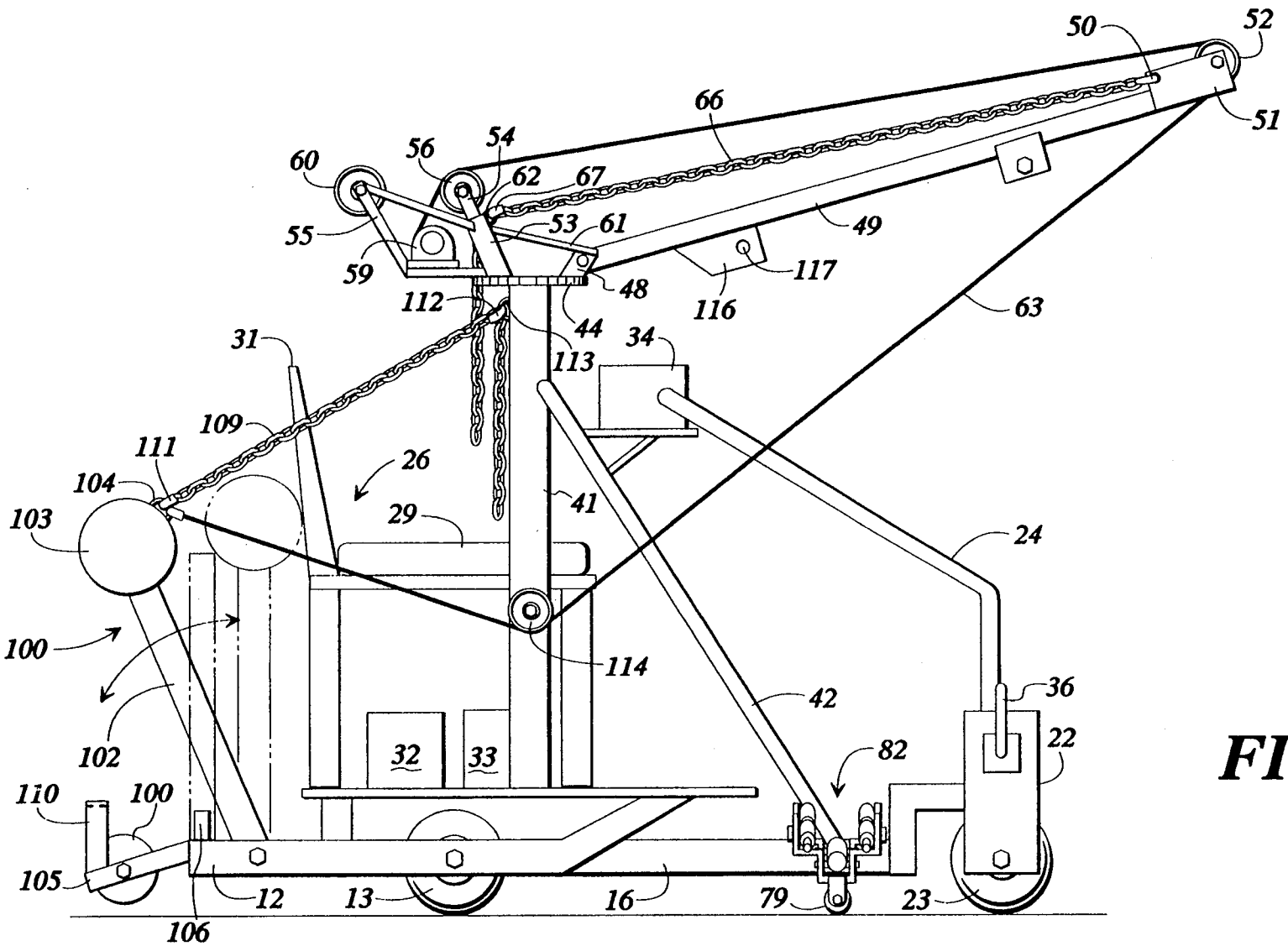
FIG. 2 is a side elevation view of the crane of FIG. 1.

As pointed out in the foregoing, where extra heavy loads are carried by crane 11, with the boom 49 extending forward in the general direction of the longitudinal axis, it is possible that the crane 11 may tend to tip forward. Although stabilizing and limiting assemblies 81 and 82 and arms 71 and 72 will resist, at least to some extent, this forward tip tendency, it is possible that the load will be heavy enough to overcome the resistance or at least to interfere with the swiveling of bracket 22 by placing too much weight thereon. Thus, as best seen in FIGS. 1 and 2, a counterweight stabilizing assembly 100 is provided on crane 11, which comprises first and second support arms 101 and 102, each having its proximal end pivotally mounted to frame 12 and either side, with their distal ends supporting a weight member such as a hollow counterweight canister 103, preferably welded thereto. Canister 103 may be filled with sand, stone, shot, scrap metal, or other weighty material, or it may be a solid member of steel, for example. Affixed to canister 103, as by welding, is an eye member 104, the function of which will be explained more fully hereinafter. First and second pins 106 and 107, are affixed to frame 12 and extend upwardly therefrom. Pins 106 and 107 are each adapted to receive and hold hollow pipe members 108, 108, shown in dashed outline in FIG. 2. Pipe members 108, 108 function to hold canister 103 in its upright position as shown in dashed outline in FIG. 2, and are removed when canister 103 is to be positioned in other than its upright position. As indicted by the arrow, canister 103 can be swung through an arc lying in a vertical plane that contains the longitudinal axis of the frame from a substantially vertical or upright position, or any angular position intermediate the extremes. When positioned at the desired angle for stabilization, the canister 103 is held is place by a retaining chain 109 hooked at one end by any suitable means 111 to eye member 104 and by a suitable attaching means 112 to an eye member 113 welded or otherwise affixed to post 41.

Positioning of the canister 103 at the optimum angle for stabilizing, which depends upon the load to be carried, is accomplished without the operator being required to lift or move any heavy weight. Mounted to post 41 and rotatable with respect thereto is a grooved wheel 114. The operator pays out a length of cable 63 sufficient to pass it under wheel 114 which guides the cable and hook its end to eye 104. With retaining chain 109 unhooked from eye 113, the operator can then pay out or take up cable 63 by means of motor 58 and winch 59 until canister 103 is positioned at the desired angle, and then chain 109 is fastened to eye 113. Cable 63 can then be unhooked from eye 104 and its end returned to a position such as is shown in FIG. 1. For safety, chain 109 is always connected between eyes 104 and 113 except during the positioning operation as just described, although when pipe members 108, 108 are in place, retention by chain 109 is not strictly necessary except as an additional safety measure.

For additional stability of the crane 11, especially during adjustment of the canister 103, a stabilizing wheel 100 is mounted in a rearwardly extending bracket 105 which is welded to the rear of the frame 12, as best seen in FIG. 2. An upwardly extending bracket is welded to bracket 105, as shown. Wheel 100 primarily limits any tendency to rearward tipping of crane 11 when canister 103 is extended outward and downward, and before a load is attached to hook or lifting or grasping device 64.

As discussed hereinbefore, the angle of boom 49 with respect to the ground or the horizontal, i.e., the vertical angle, can be set for optimum performance by the operator without the necessity of lifting or moving the boom 49 by hand. To this end, a bracket 116 having a hole 117 therein is affixed, as by welding, to the underside of the boom 49, preferably within reach of an operator sitting in chair 26. To adjust the boom angle, the operator hooks hook 64 at the end of cable 63 into hole 117, as shown in FIG. 3, and then unhooks chain 66 from member 62. The end of boom 49 can then be raised by taking up cable 63 on winch 59 by activating motor 58, or lowered by paying out cable 63 from winch 57 by reversing motor 58, until the desired position is reached. Chain 66 is then re-connected to member 62 by means 67, and cable 63 is disconnected from bracket 116 and returned to its load carrying position.

From the foregoing, it can be seen that the necessary positioning of the boom 49 for optimum load carrying, and of the counterweight assembly 100 for optimum stability can be accomplished by the operator without the necessity of lifting or moving any heavy weights, or even leaving seat 26. Thus, a handicapped or partially disabled operator can operate the crane 11 to the full extent of its capabilities without the risk of aggravating any pre-existing injury or disability.

In FIG. 5, there is shown an auxiliary boom 118, which is pivotally mounted at one end to a bracket 119 having first and second plates 121 and 122 and which is affixed to the underside of boom 49 by suitable means, such as by welding. At the distal end 123 of boom 118 is a hook or other lifting device 124 pivotally mounted thereto. A lifting arm 126 is affixed to end 123 by welding, for example, and extends along a portion of the length of boom 118 at an angle to the longitudinal axis thereof, and terminates in an eye member 127, which is adapted to receive hook 64 at the end of cable 63. A strengthening member 128 is provided, welded to both arm 126 and boom 118. Boom 118 can be raised or lowered by taking up or paying out cable 63, and functions as an extension of boom 49 to enable access to places that are relatively inaccessible to boom 49. With the arrangement shown in FIG. 5, the operator can, for example, direct the end of boom 118 into the interior of an automobile to remove a bag of groceries, luggage, or the like. In addition, only a small take-up of cable 63, which would not provide sufficient lift distance, will lift hook 124 a greater distance, a feature that is advantageous where space is restricted cramped, especially in a vertical direction.

Referring again to FIG. 3, where the crane 11 is to be used to pull heavy objects, cable 63 is passed from drum 59 over grooved wheel 60, as shown in dashed liner, and down and under a grooved wheel 131, to extend to the rear, as shown. Wheel 131 is supported in a bracket 132; which may be to facilitate passing the cable 63 therethrough, made in two separable parts which are clamped together after the cable is threaded under wheel 131. Bracket 132, which, with wheel 131, is a separate accessory assembly, can be attached by suitable means 133 to bracket 110. In practice it has been found that attaching means 133 may take the form of a hook which hooks under the cross piece of bracket 110. Because the force on wheel 131 and bracket 132 is upward and outward (to the left as viewed in FIG. 3) when a load is being towed, hook 133 remains engaged with bracket 110 during the pulling operation.

The crane of the invention is especially adaptable for use by persons with back injuries or other handicaps which can be aggravated by the necessity of moving heavyweights. Thus, the crane is capable of performing all of the functions to the full capacity of cranes of comparable size, without placing strain upon the operator in its use, and without the operator having to leave his seat on the crane either to set it or to run it.

The principles of the present invention have been illustrated in a preferred embodiment thereof. Various changes, alternations, or modifications within the purview of workers in the art may be made without departure from the spirit and scope of the present invention.

I claim:

1. A mobile crane comprising:

a frame having a longitudinal axis and front and rear ends lying in a first plane, a platform mounted on said frame, a plurality of wheels rotatably mounted of said frame, and least one of said wheels being swivelly mounted to said frame, a support member on said platform, an elongated boom having a longitudinal axis, mounting means for swivelly mounting said boom to said support member for movement above a vertical axis, said boom being swivelly mounted to said mounting means for movement in a vertical plane, a counterweight assembly pivotally mounted at the rear end of said frame on axis vertically and horizontally displaced from said mounting means and lying substantially in said first plane, said counterweight assembly comprising an elongated support arm having a proximal end pivotally mounted to said frame and a weight member mounted to its distal end, said support arm being movable through the arc independently of said elongated boom, said means for moving said counterweight assembly including a lifting cable extending said boom having a free, distal end, and means for coupling said distal end to said weight member.

2. A mobile crane as claimed in claim 1 wherein said means for moving said counterweight assembly includes winch means for taking up and paying out said cable.

3. A mobile crane as claimed in claim 2 wherein said winch means is mounted to said support member.

4. A mobile crane as claimed in claim 2 and further including guide means mounted on said support member for guiding said cable.

5. A mobile crane as claimed in claim 2 and further including means for fixing said counterweight assembly in a stabilizing position.

* * * * *